US006749550B1

(12) United States Patent
Chiu

(10) Patent No.: US 6,749,550 B1
(45) Date of Patent: Jun. 15, 2004

(54) CENTRAL DRIVE LINKAGE FOR CUTTING AND CREASING MACHINE

(75) Inventor: Hsin-Fa Chiu, Taipei (TW)

(73) Assignee: SBL Machinery Co., Ltd., Taipei (TW)

( * ) Notice: Subject to any disclaimer, the term of this patent is extended or adjusted under 35 U.S.C. 154(b) by 0 days.

(21) Appl. No.: 10/396,835

(22) Filed: Mar. 26, 2003

(51) Int. Cl.[7] ..... B31B 1/88
(52) U.S. Cl. ..... 493/56; 74/47
(58) Field of Search ..... 493/56; 74/47, 74/425

(56) References Cited

U.S. PATENT DOCUMENTS 4,475,495 A * 10/1984 Lydell ..... 123/197.3
5,012,147 A * 4/1991 Bertram et al. ..... 310/80
5,839,381 A * 11/1998 Woelfle ..... 112/221
6,289,754 B1 * 9/2001 Doege et al. ..... 74/44
6,363,823 B1 * 4/2002 Myers et al. ..... 83/241

* cited by examiner

*Primary Examiner*—Stephen F. Gerrity
*Assistant Examiner*—Hemant M. Desai

(74) *Attorney, Agent, or Firm*—Bacon and Thomas, PLLC

(57) ABSTRACT

This invention concerns an improvement of the central drive linkage for the cutting and creasing machine which comprises at least a plurality of differential gears mounted on the upper part, and a plurality of fine-tuning mechanism evenly distributed on the lower part; in which the main drive shaft and the counter weight of the differential gears are arranged in the eccentric manner so as to generate relatively angular differentials as the central drive linkage rotates. The counter weight has a connecting rod linking to a crankshaft which has an upper end connected to the workbench and a lower end to the fine-tuning mechanism in order to obtain comparatively stable working torque output and precise performance and to attain the intermittent change of slow lifting and fast lowering of the workbench movement. Four sets of fine-tuning mechanisms are evenly disposed under and support the overall weight of the differential gears. The top surface of the fine-tuning mechanism forms an arch cavity with two-fan type fixing lips to hold the crank web in place and fastened by adjusting bolts to secure the proper left or right displacement of the crankshaft. Such an arrangement will ensure the intimate contact between the crank web and cavity, gain adequate working elevation for crankshaft through the adjustment of the fine-tuning mechanism and maintain the workbench in straight level during the operation without slight slant. This will achieve the greatest stability.

2 Claims, 6 Drawing Sheets

CENTRAL DRIVE LINKAGE FOR CUTTING AND CREASING MACHINE

FIELD OF THE INVENTION

This invention relates to an improvement of the central drive linkage of the cutting and creasing machine, in particular, it consists of a main drive shaft and a counter weight eccentrically disposed to generate relatively angular differentials to gain full control over the lifting and lowering velocity of the workbench.

BACKGROUND OF THE INVENTION

The prior art of central drive linkage of the cutting and creasing machine comprises only one single set of differential gear. In order to render board applications and to perform paper cutting of all descriptions in size, volume and grade, the cutting and creasing machine must be designed with large scale and bulky volume, requiring great space for erection. Since the cutting and creasing machine is composed of many functional units to carry out a variety of tasks, the power output shall be tremendously strong. If the power supplied is not sufficient enough, it certainly led to frequent trouble.

In the prior art of central drive linkage, the power out comes uniquely from a single differential gear whose power is surely inadequate to satisfy the changing task requirements. The differential gear is installed on one side of the central chamber of the cutting and creasing machine, during the process of vertical power transmission, because the force imposed on the bottom is not evenly distributed, it will produce a feedback retrogression which will probably deform the main drive shaft in case that the main drive shaft produces very excessive torque moment. Should the bottom support render uneven and unstable power transmission, the accuracy of the product and the service life span of the machine would be adversely affected. It is an uneconomical practice.

The working efficacy of the cutting and creasing machine depends largely on the product accuracy, service life and mobility. How to develop and perfect the central drive linkage of the cutting and creasing machine has been a critical aim the related industry has to strike for.

SUMMARY OF THE INVENTION

The primary object of this invention is to provide an improved structure of central drive linkage for the cutting and creasing machine in which a plurality of differential gears and fine-tuning mechanism are employed to enhance the stability of power output. The differential gears comprise a main drive shaft and a counter weight eccentrically disposed to generate a relatively angular differential in the rotary operation so as to attain the required slow and fast movement. The differential gear links with the crankshaft, which connects to the workbench and the fine-tuning mechanism respectively. By the power transmission coming from the differential gear ensures strict control of the lifting and lowering movement of the crankshaft and by the change of the relative angular difference occurred between the main drive shaft and the counter weight ensures an intermittent slow lifting and fast lowering of the crankshaft.

Another object of this invention is to improve the linkage structure where a plurality of fine-tuning mechanisms are evenly distributed directly under the differential gears, least feedback retrogression will generate to deform the main drive shaft, the more stable the power transmission and power recipient is, the more accurate the product will be and longer the service life is.

Another object of this invention to provide an improved central drive linkage where the differential gear is mount on one side of the central seat to attain an equal angle or changing relative angle against the main drive shaft during the rotary operation and obtain a maximum flexibility as designed in movement curve which renders great mobility and convenience in operation.

The features, objects and performance are explained in great detail with an aid the preferable embodiments as illustrated in the drawings.

DETAILED DESCRIPTION OF THE INVENTION

As shown in FIG. 1, there are three sets of differential gears 1 mounted on the upper part and four sets of fine-tuning mechanisms 2 distributed on the lower part of the central seat.

As shown In FIGS. 2 through 4, the differential gear 1 mainly comprises a main drive shaft 10, a main worm gear 11, a counter weigh 12 eccentrically disposed on the side of the main worm gear 11 with a propeller fan 121 on the other side of work gear 11. The eccentric arrangement of main drive shaft 10 and the counter weight 12 will generate relative angular differentials when the linkage rotates.

As shown in FIG. 2, there are several connecting rods 13 link to the crankshaft 14 and separated by disk 131. The crankshaft 14 has an upper end connected to workbench 3 and a lower end fixed on fine-tuning mechanism 2. When the main drive shaft 10 runs the counter weight 12, a relative angular differential is produced. The connecting rod 13 will bring the crankshaft 14 into motion to produce an intermittent slow lifting and fast lowering on the workbench 3.

As shown in FIGS. 2 through 5, there are four sets of fine-tuning mechanisms 2 evenly distributed along the central drive linkage. Each fine-tuning mechanism 2 has a slide block 20 at the bottom, and a pair of slide blocks 20 are mounted on one slide rod 21 for timely adjustment of distance to ensure a balanced gravity and transmitting power and to attain the accuracy as well as longer service life. The top of the fine-tuning mechanism forms an arch cavity 22 with two fixing lips 23 on the far end of the cavity 22. The crank web 14 is held in the cavity 22 and locked onto the fixing lips 23 by the adjusting bolts 231. By transverse swing of the fixing lips 23 and adequate adjustment and lock of bolts 231, the position of the crankshaft can be obtained so the straight level of workbench 3 can always be maintained without slight slant.

The special features of the improved central drive linkage for the cutting and creasing machine are that when the main drive shaft 10 is started to bring the counter weight 12 into rotation. Due to the eccentric arrangement, it produces relatively angular differentials as shown in FIG. 3 where A is an axial distance between the main drive shaft 10 and the counter weight 12; B is the rotary angle of the main drive shaft; C is rotating angle of the counter weight 12. The angular difference between B and C will show slow or fast displacement of the crankshaft 14. The variation of actual angles is illustrated in FIG. 6. The angular differential represents how slow or fast the crankshaft 14 is moving which complies with the slow lifting and fast lowering of the workbench 3 as controlled by the central drive linkage 1. Since the main drive shaft 10 sits in the center of the central drove linkage, allowing the counter weight 10 to generate better power transmission and strength to prevent the fine-tuning mechanism 2 from arising excessive feedback retrogression which might cause a deformation on the main drive shaft 10 produces excessive torque moment.

Furthermore, as shown FIG. 1, the central drive linkage 1 is provided with an additional differential gear 1 at its far left side to obtain an equal angle or relative angular differential for the main drive shaft 10. This design enhances the flexibility of movement curve and extends the multiple applications.

Viewing from the above mentioned statement, it is apparent that the improved central drive linkage for the cutting and creasing machine is novel, creative and practicable, justified for favorable grant of new patent.

Figure 1:
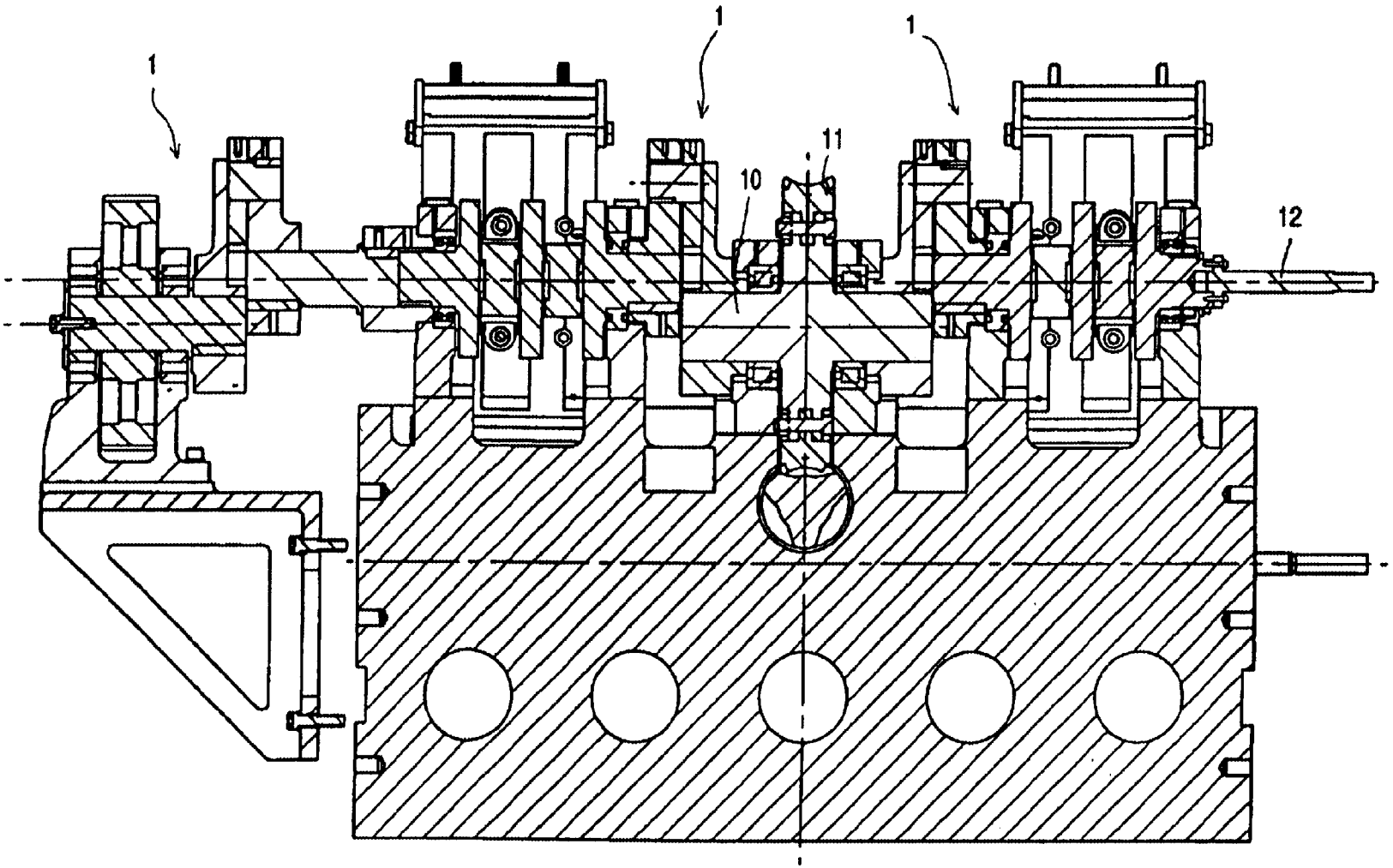
FIG. 1 is the cross-section of the central drive linkage for the cutting and creasing machine of this invention.
Figure 2:
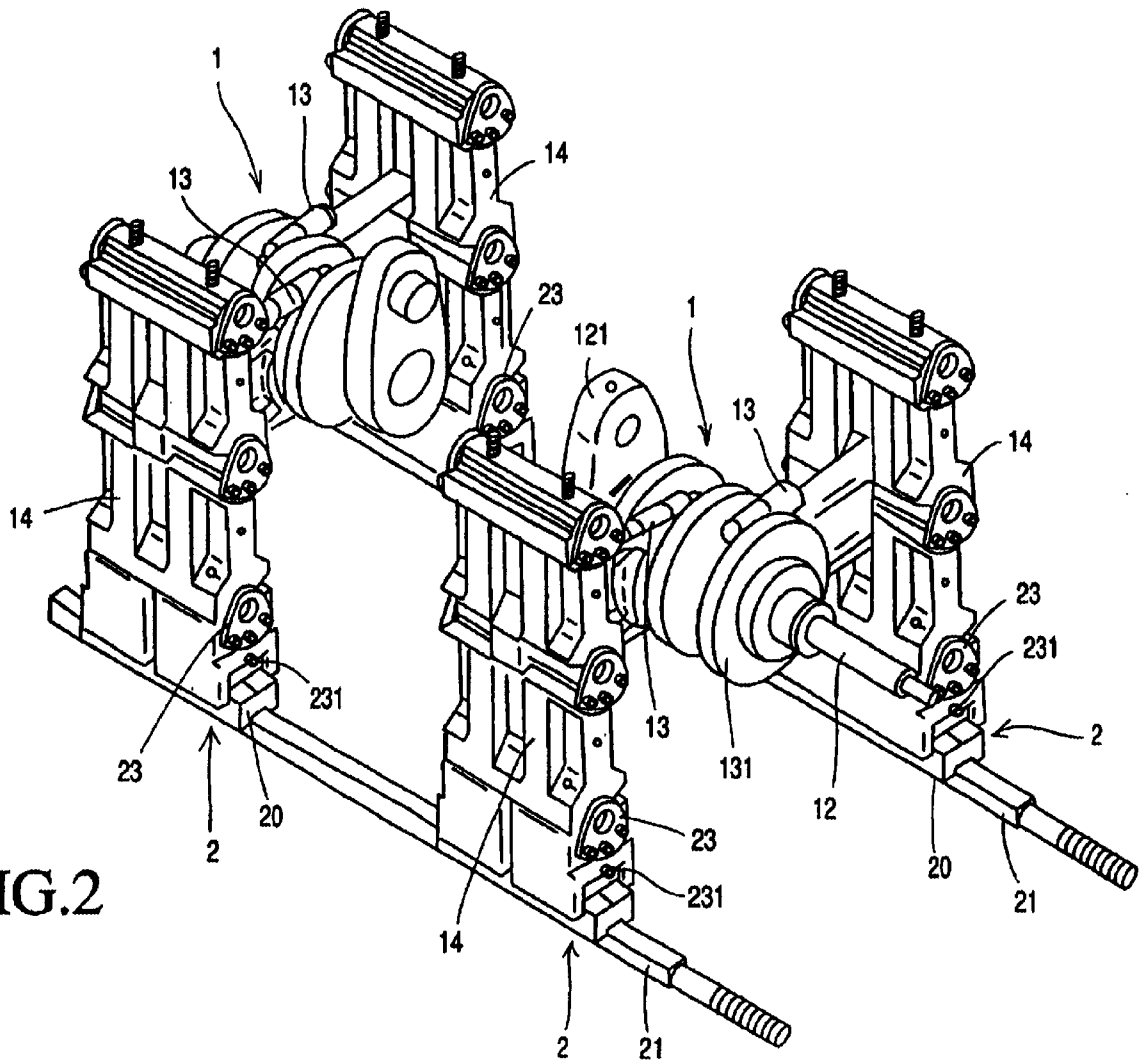
FIG. 2 is an appearance of the central drive linkage for the cutting and creasing machine of this invention.
Figure 3:
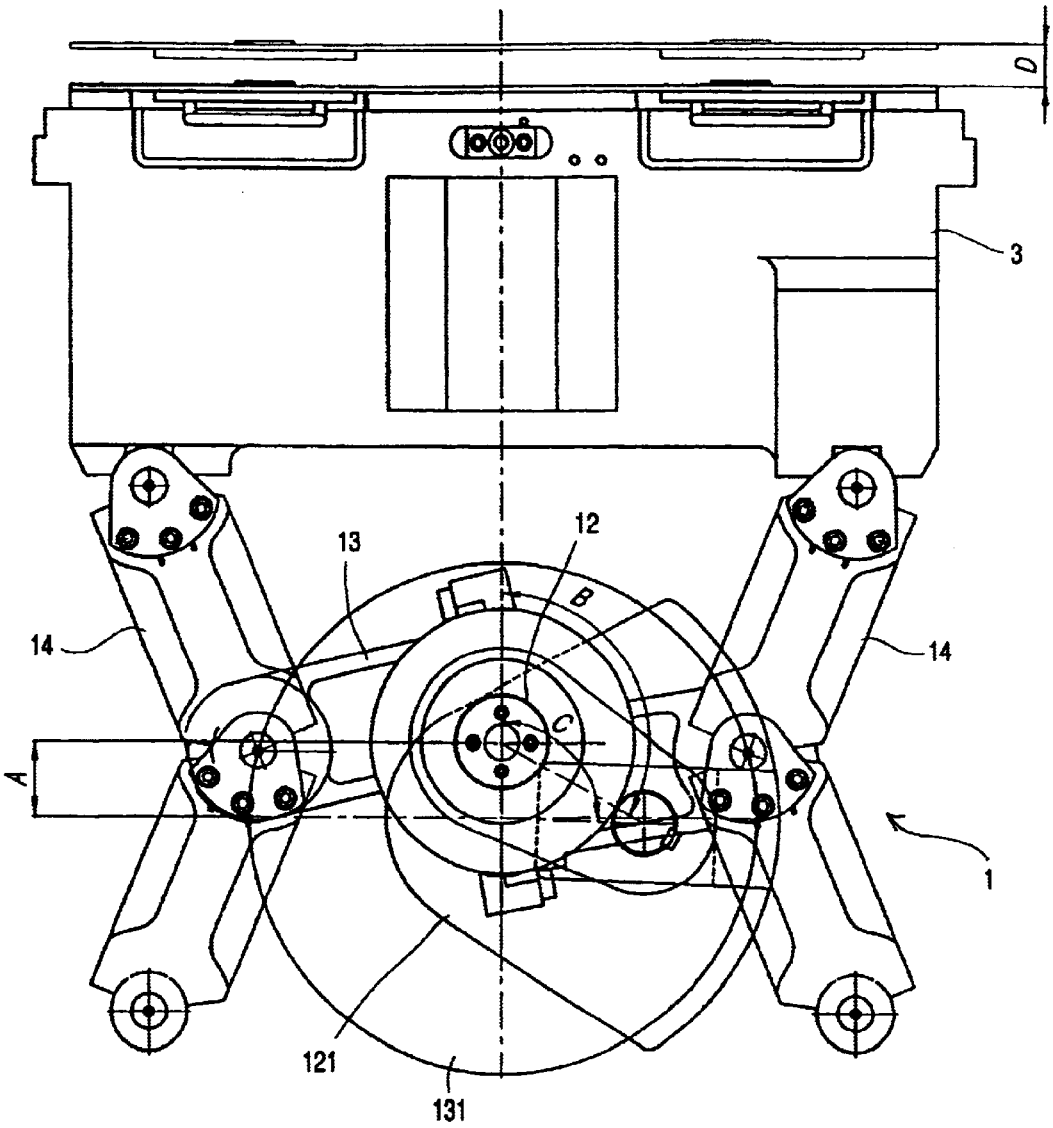
FIG. 3 is a side view and action diagram of the differential gear of the central drive linkage for the cutting and creasing machine of this invention.
Figure 4:
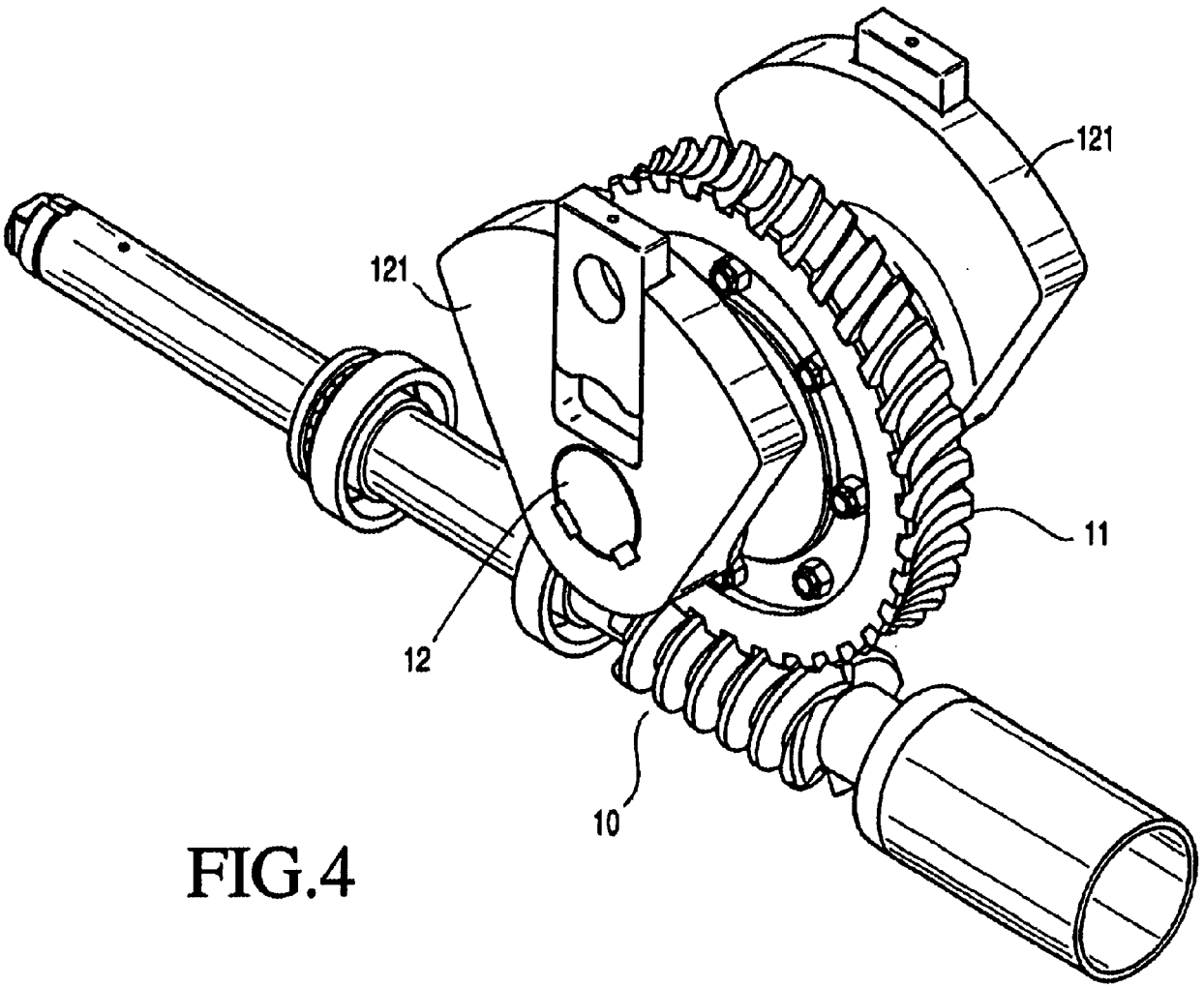
FIG. 4 is a stereo appearance of the differential gear of the central drive linkage for the cutting and creasing machine of this invention.
Figure 5:
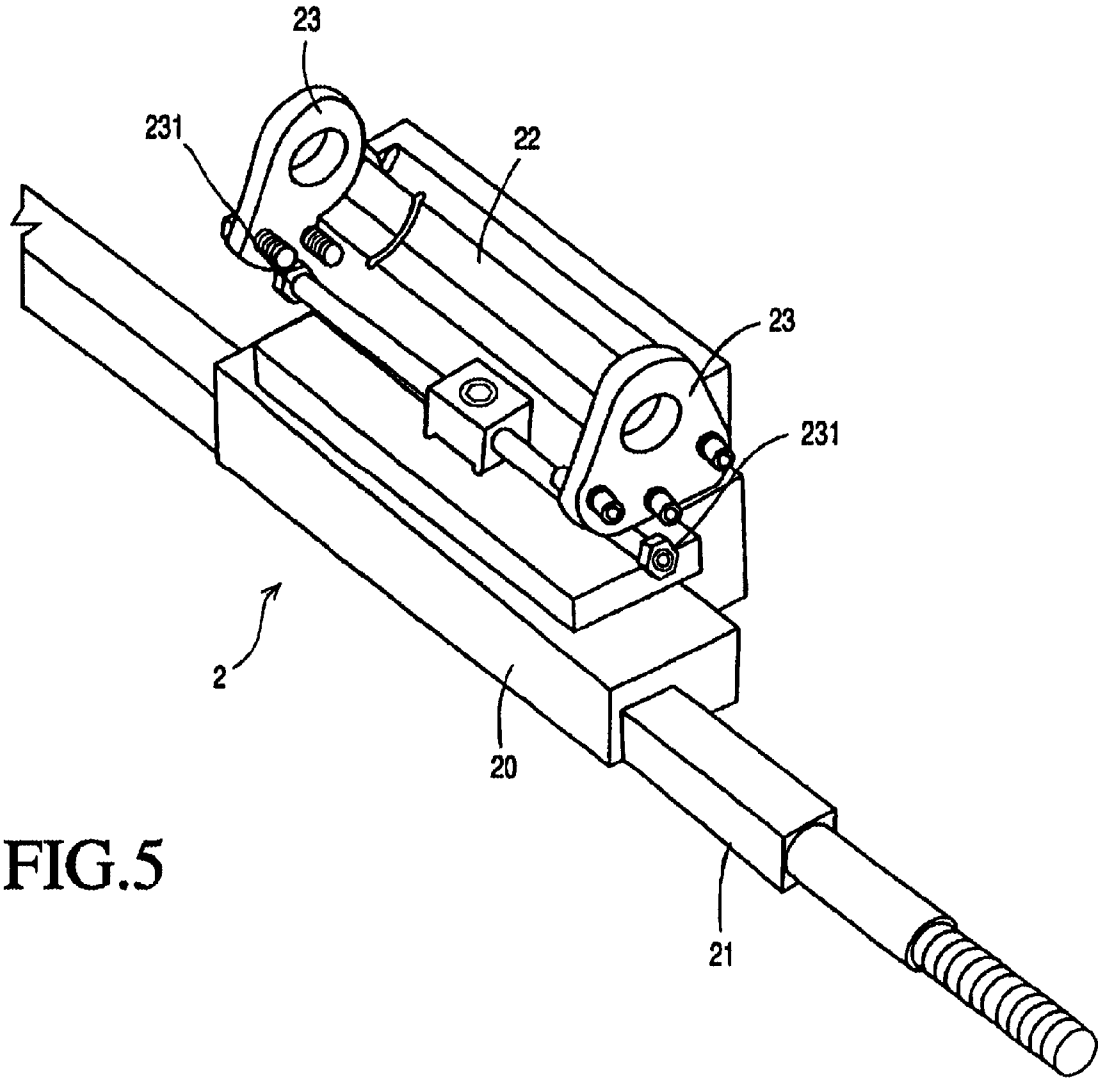
FIG. 5 shows an appearance of the fine-tuning mechanism of the central drive linkage for the cutting and creasing machine of this invention.
Figure 6:
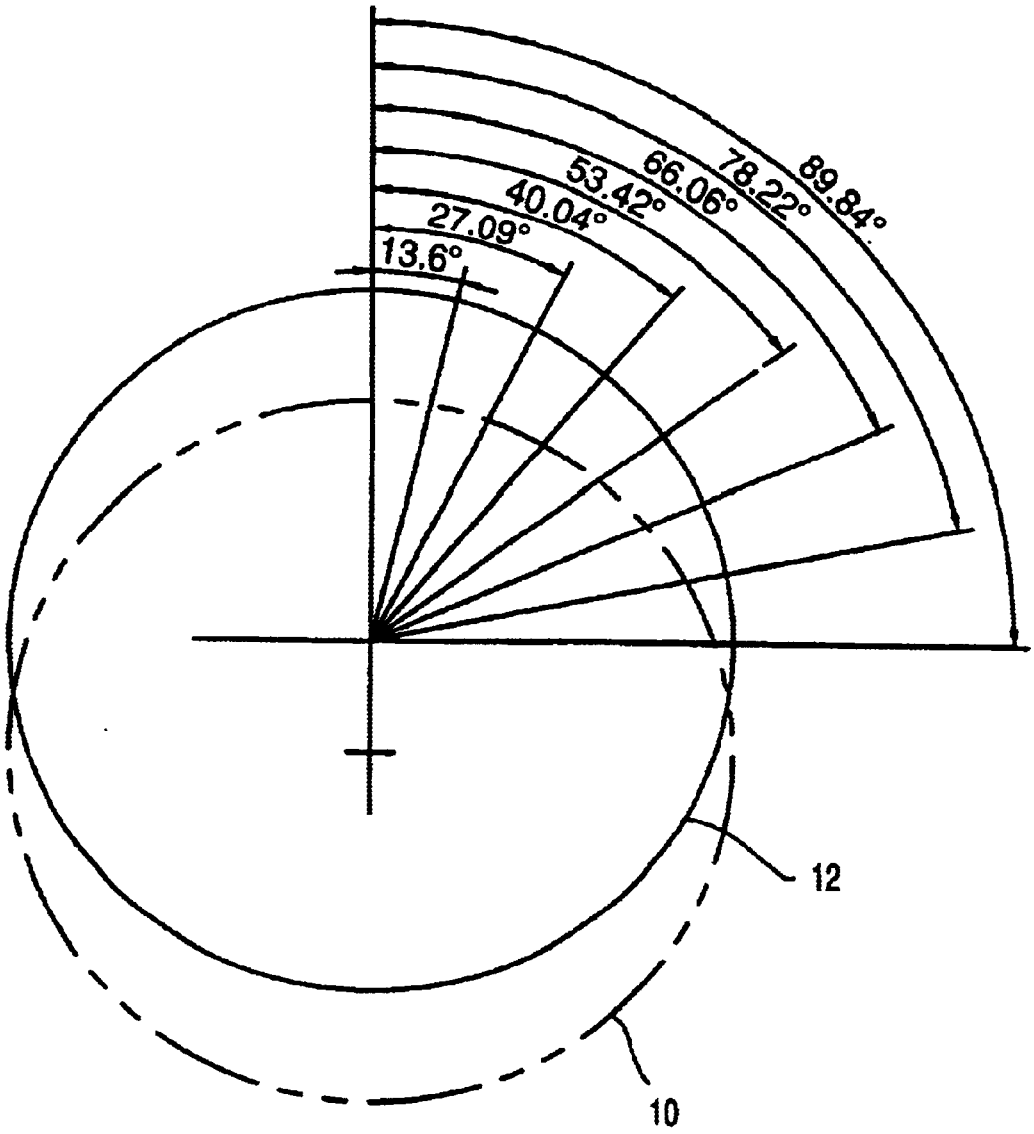
FIG. 6 shows the angular change in the differential gear of the central drive linkage for the cutting and creasing machine of this invention.

What is claimed is:

1. A central drive linkage for a cutting and creasing machine, wherein said central drive linkage mainly comprises a differential gear installed on an upper part and a fine-tuning mechanism mounted on a lower part, characterized in that:

said differential gear consists of one main drive shaft installed in a center of said central drive linkage and a worm gear meshed closely with a main drive shaft, said worm gear has a counter weigh at one end and a propeller fan at the other end, disposed eccentrically with said main drive shaft, said counter weight has several connecting rods, each of said connecting rods links to a crankshaft and separated by a disk, said crankshaft has an upper end connected to a workbench and a lower end to a fine-tuning mechanism, when said main drive shaft brings said worm gear and said counter weight into rotary movement, said main drive shaft would produce relatively angular differentials, said crankshaft is also brought into action by said connecting rod to create a slow lifting and fast lowering movement on said workbench;

there are four sets of said fine-tuning mechanisms evenly distributed on a bottom of said central drive linkage, said fine-tuning mechanism has a slide block at a bottom, two identical slide blocks are linked on one slide rod for adequately adjusting displacement and force dispersion, a top of said fine-tuning mechanism forms an arch cavity with two fixing lips on both side to house a crank web and receive several adjusting bolts to lock said crank web within said cavity and fixing lips, so said fine-tuning mechanism can make close contract with and effectively control positions of said crankshaft and keep said workbench always on a level without slight slant.

2. The central drive linkage for a cutting and creasing machine of claim 1, wherein an additional differential is provided at a far left end of said central drive linkage so as to attain another eccentric displacement in a rotary operation, this design will enhance flexibility of movement curves and extend application of said central drive linkage for a cutting and creasing machine of this invention.

* * * * *